US007281940B1

(12) United States Patent
Chuang

(10) Patent No.: US 7,281,940 B1
(45) Date of Patent: Oct. 16, 2007

(54) REMOVABLE ELECTRICAL INTERFACE DEVICE AND ELECTRONIC APPARATUS HAVING THE SAME

(75) Inventor: Chih-Peng Chuang, Taipei (TW)

(73) Assignee: Inventec Corporation (TW)

( * ) Notice: Subject to any disclaimer, the term of this patent is extended or adjusted under 35 U.S.C. 154(b) by 0 days.

(21) Appl. No.: 11/605,581

(22) Filed: Nov. 28, 2006

(51) Int. Cl.
*H01R 13/64* (2006.01)

(52) U.S. Cl. ..... 439/374; 439/540.1; 439/928.1

(58) Field of Classification Search ..... 439/374, 439/928.1, 540.1
See application file for complete search history.

(56) References Cited

U.S. PATENT DOCUMENTS 5,233,594 A * 8/1993 Wilhelm ..... 361/685
5,316,423 A * 5/1994 Kin ..... 411/510
5,808,867 A * 9/1998 Wang ..... 361/695
6,716,035 B2 * 4/2004 Haager et al. ..... 439/64

* cited by examiner

*Primary Examiner*—Tho D. Ta
(74) *Attorney, Agent, or Firm*—Peter F. Corless; Steven M. Jensen; Edwards Angell Palmer & Dodge LLP

(57) ABSTRACT

A removable electrical interface device insertable into an electronic apparatus having a slot and two first coupling portions includes a body and a lid. The body is adapted to be inserted into the slot and electrically connected to the electronic apparatus. The lid is perpendicularly connected to a side of the body, connectable to a surface of the electronic apparatus, adapted to seal the slot, has two second coupling portions fastenable to the two first coupling portions respectively, and allows the removable electrical interface device to be installed and uninstalled by a single act. The present invention further provides an electronic apparatus having the removable electrical interface device.

10 Claims, 3 Drawing Sheets

REMOVABLE ELECTRICAL INTERFACE DEVICE AND ELECTRONIC APPARATUS HAVING THE SAME

BACKGROUND OF THE INVENTION

1. Field of the Invention

The present invention relates to an electrical interface device, and more particularly, to a removable electrical interface device insertable into an electronic apparatus.

2. Description of the Prior Art

With continual advances in electronic technology, information-related electronic devices are widely used by users of different age groups. In the face of keen competition, manufacturers nowadays do their best to cut production costs in order to increase the competition edges of their products. In the eyes of the manufacturers nowadays, potential topics of research and development should cover whatever hardware-specific improvements made in an information-related electronic device, provided that the improvements are conducive to simplification of hardware structure, ease of installation and uninstallation, and reduction in production costs.

Most of the manufacturers nowadays are equipped with a medium-sized or large server to compile, backup, manage and integrate important data stored in small servers and personal computers at workplace and minimize their spending on the unnecessarily large number of information-related electronic devices they use.

However, a careless assembly worker is likely to cause any of the numerous parts and components of a server to deform. Deformed parts and components are unusable, resulting in an increase in production costs.

A conventional electronic apparatus, such as a server, comprises a control unit, a storage unit, and a center module disposed between and connecting the control unit and storage unit. The body of the center module is shaped like a panel so as to be perpendicularly inserted into the server. The body is bilaterally fixedly disposed with a circuit board having an electrical port for electrically connecting the control unit and storage unit flanking the body. The server is covered with a lid for sealing a receiving space of the server after the body is inserted into the receiving space. The prior art teaches the following: the lid and body are separable and need to be fastened in position; the body is bilaterally fixedly disposed with a circuit board having an electrical port for electrically connecting the control unit and storage unit of the server; the server comprises a receiving space for receiving the body; an assembly worker electrically connects the control unit to the storage unit by means of the electrical port, closes the lid, checks and sees whether the lid and the body are tightly coupled together and perpendicular to each other, and whether the body is already deformed due to improper installation; upon discovery of a deformed body, the assembly worker should promptly change the deformed body; accordingly, the deformed body is unusable and thereby increases production costs. Another disadvantage of the prior art is as follows: since the body and the lid are not combined into a single integral piece, the upper half of the body is supported by nothing at all, and in consequence the body tends to bend or deform at the moment when the storage unit is installed or withdrawn. Last but not least, uninstallation of the body has to follow uninstallation of the lid, which is inconvenient to any assembly worker.

Installation of a conventional electronic apparatus is complex, time-consuming and laborious, because the conventional electronic apparatus comprises plenty of parts and components and the installation process entails using a tool. The parts and components of the conventional electronic apparatus can be deformed by careless assembly workers, not to mention the inefficiency and high cost of the installation process.

Accordingly, an issue calling for urgent solution is to develop a removable electrical interface device and an electronic apparatus having the removable electrical interface device so as to facilitate installation, plugging and unplugging of the removable electrical interface device, protect the removable electrical interface device from deformation, make the structure of the removable electrical interface device simpler, and reduce the production costs of the removable electrical interface device.

SUMMARY OF THE INVENTION

In light of the aforesaid drawbacks of the prior art, it is a primary objective of the present invention to provide a removable electrical interface device and an electronic apparatus having the removable electrical interface device, so as to facilitate installation, plugging and unplugging of the removable electrical interface device.

Another objective of the present invention is to provide a removable electrical interface device and an electronic apparatus having the removable electrical interface device, such that the removable electrical interface device is well-supported and deformation-resistant.

Yet another objective of the present invention is to provide a removable electrical interface device and an electronic apparatus having the removable electrical interface device, to make the structure of the removable electrical interface device simpler and reduce the production costs of the removable electrical interface device.

In order to achieve the above and other objectives, the present invention provides a removable electrical interface device insertable into an electronic apparatus having a slot and two first coupling portions. The removable electrical interface device comprises a body and a lid. The body is insertable into the slot and electrically connectable to the electronic apparatus. The lid is perpendicularly connected to a side of the body, connectable to a surface of the electronic apparatus, adapted to seal the slot, and connectable to second coupling portions fastenable to the first coupling portions respectively. The removable electrical interface device can be installed and uninstalled by a single act.

The second coupling portions are two resilient fasteners respectively disposed fixedly at two ends of the body and exposed from the lid. The resilient fasteners each have a top end disposed with an operating flange protruding from the lid. In a preferred embodiment, the lid is disposed with a first opening for exposing the operating flange of each of the resilient fasteners. A lateral side of the lid is disposed with a second opening communicating with the first opening disposed in the upper surface of the lid, thus allowing a user to push the operating flange from the lateral side of the lid. A hook is disposed on each of the resilient fasteners, flanked by the operating flange, and fastenable to a respective one of the first coupling portions of the electronic apparatus, for example, a fastening hole. Fastening resilient fasteners to the electronic apparatus secures in position the removable electrical interface device in the electronic apparatus. On the other hand, to uninstall the removable electrical interface device from the electronic apparatus, a user only needs to push the operating flange until the hook snaps out of the respective one of the first coupling portions of the electronic apparatus, and then the user withdraws the lid and body from the electronic apparatus. Accordingly, not only does a user install/uninstall the removable electrical interface device in/from the electronic apparatus easily, but the structure of the body is reinforced because of the lid and therefore the body is protected from deformation.

To achieve the same objectives, the present invention further provides an electronic apparatus having the removable electrical interface device. The electronic apparatus comprises: a casing disposed internally with a control unit, a storage unit, and a slot between the control unit and the storage unit and disposed with two first coupling portions corresponding in position to two ends of the slot; and a removable electrical interface device having a body and a lid, the body being adapted to be inserted into the slot and electrically connect the control unit and the storage unit, the lid being perpendicularly connected to a side of the body, connectable to a surface of the casing, adapted to seal the slot, and having two second coupling portions fastenable to the two first coupling portions respectively, thus allowing the removable electrical interface device to be installed and uninstalled by a single act.

Disposed on two sides of the body of the removable electrical interface device are circuit boards having electrical ports for electrical connection of the control unit and the storage unit. The body is shaped like a panel. The slot adapted to be inserted by the body is defined by a plurality of guiding posts inwardly disposed on two lateral sides and a bottom side of the casing.

A removable electrical interface device of the present invention comprises a body and a lid perpendicularly and integrally connected to each other to reinforce the structural strength of the body. The removable electrical interface device is insertable into a receiving space of an electronic apparatus like a server. Circuit boards equipped with electrical ports are disposed on the removable electrical interface device and adapted to electrically connect a control unit and a storage unit in the electronic apparatus. Fastening resilient fasteners connectedly disposed in the body and the lid to the electronic apparatus secures in position the removable electrical interface device in the receiving space of the electronic apparatus. On the other hand, to uninstall the removable electrical interface device from the electronic apparatus, a user only needs to push the resilient fasteners until the resilient fasteners snap out of the lid, and then the user withdraws the lid and body from the receiving space of the electronic apparatus. Accordingly, the user installs/uninstalls the removable electrical interface device in/from the electronic apparatus easily.

DETAILED DESCRIPTION OF THE PREFERRED EMBODIMENT

The following specific embodiment is provided to illustrate the present invention. Persons skilled in the art can readily gain an insight into other advantages and features of the present invention based on the contents disclosed in this specification.

Figure 1:
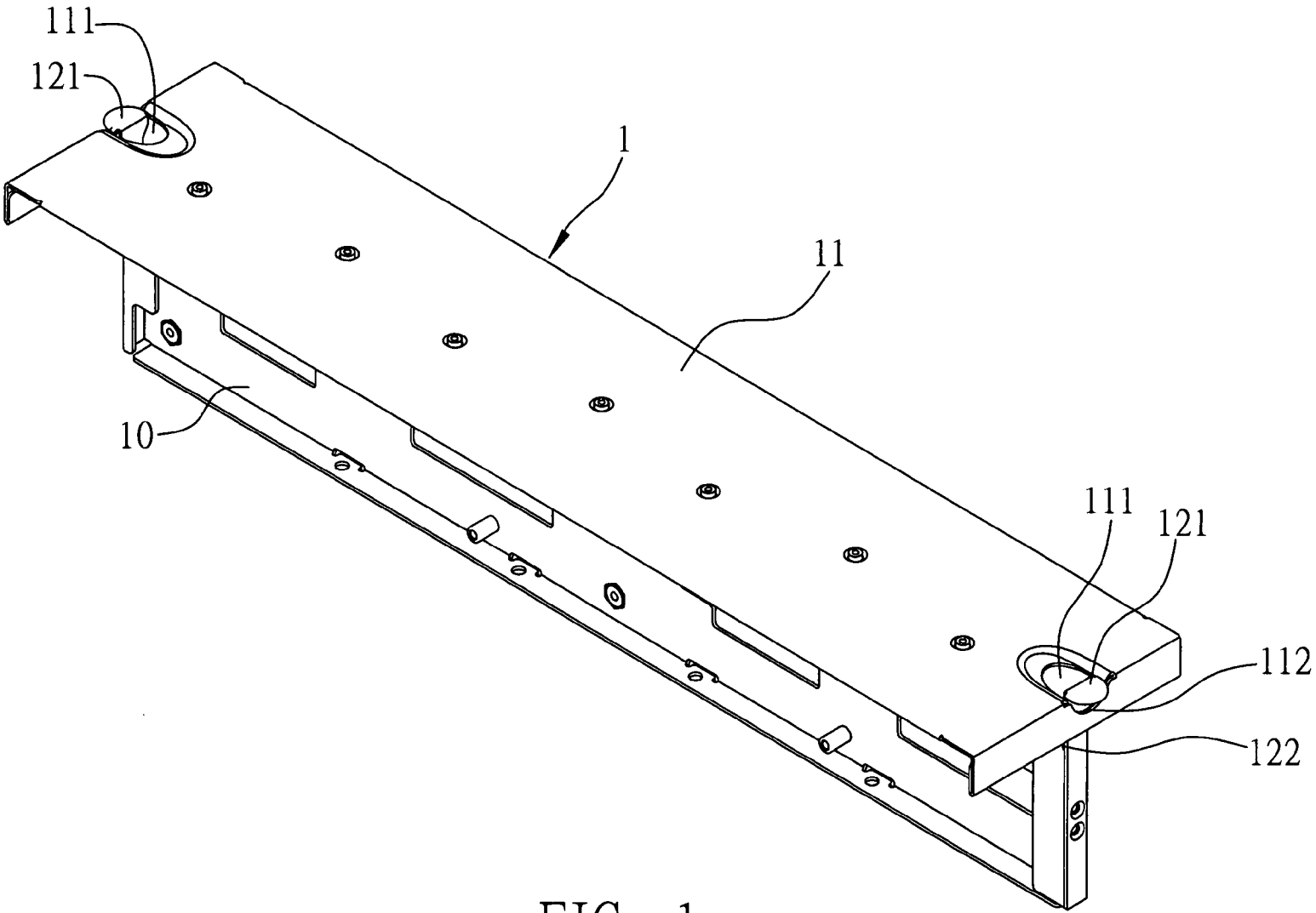
FIG. 1 is a schematic view showing a removable electrical interface device of the present invention.

Referring to FIG. 1, which is a schematic view showing a removable electrical interface device 1 of the present invention, the removable electrical interface device 1 is adapted to be insertedly disposed in an electronic apparatus 2 (shown in FIG. 3) having a slot 23 and two first coupling portions 22. The removable electrical interface device 1 comprises a body 10, a lid 11, and two second coupling portions 12 (shown in FIG. 2) fastenable to the two first coupling portions 22 respectively. In this embodiment, the two second coupling portions 12 are two resilient fasteners respectively disposed fixedly at two ends of the body 10 and exposed from the lid 11.

Both the body 10 and the lid 11 of the removable electrical interface device 1 are panel-shaped and are perpendicularly connected to each other by riveting, welding, or screwing such that the lid 11 can support the body 10 and protect the body 10 from deformation. Circuit boards having electrical ports are secured in position to two opposing sides of the body 10 respectively to electrically connect a control unit and a storage unit of the electronic apparatus 2 such as a server.

Figure 2:
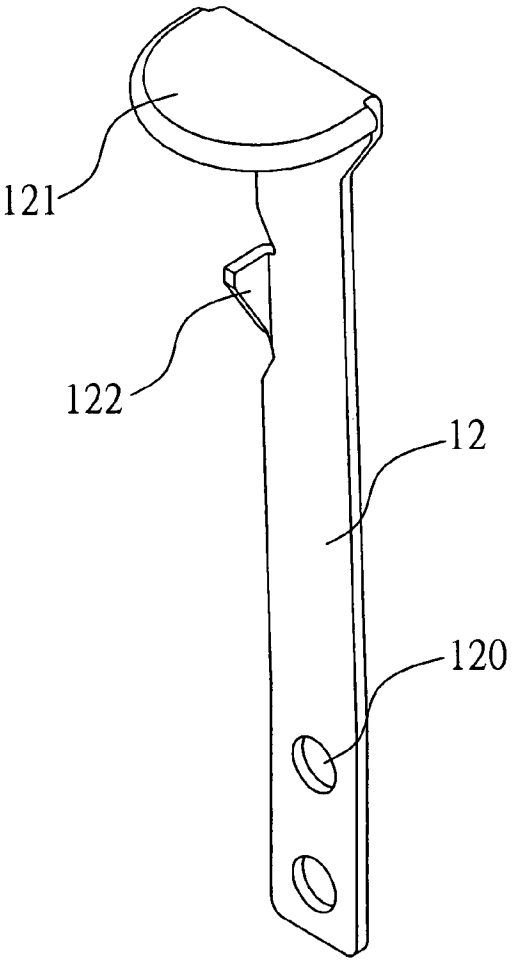
FIG. 2 is a schematic view showing a resilient fastener of the removable electrical interface device shown in FIG. 1.

Referring to FIG. 2 as well, the resilient fasteners 12 are made of metal or plastics and are exemplified by a leaf spring. One end of each of the resilient fasteners 12 is disposed with through holes 120 for riveting or screwing the resilient fasteners 12 to the two ends of the body 10. Each of the resilient fasteners 12 has a top end disposed with an operating flange 121 protruding outward. The operating flange 121 can penetrate and thereby be exposed through a first opening 111 disposed in an upper surface of the lid 11, thus allowing the operating flange 121 to abut against a side of the first opening 111. A hook 122 is disposed on each of the resilient fasteners 12, flanked by the operating flange 121, and fastenable to a respective one of the first coupling portions 22 of the electronic apparatus 2, for example, a fastening hole, as soon as the body 10 is inserted into the slot 23 of the electronic apparatus 2, thus securing in position the body 10 to the electronic apparatus 2. Also, a lateral side of the lid 11 is disposed with a second opening 112 communicating with the first opening 111 disposed in the upper surface of the lid 11, thus allowing a user to push the operating flange 121 with a finger.

Figure 3:
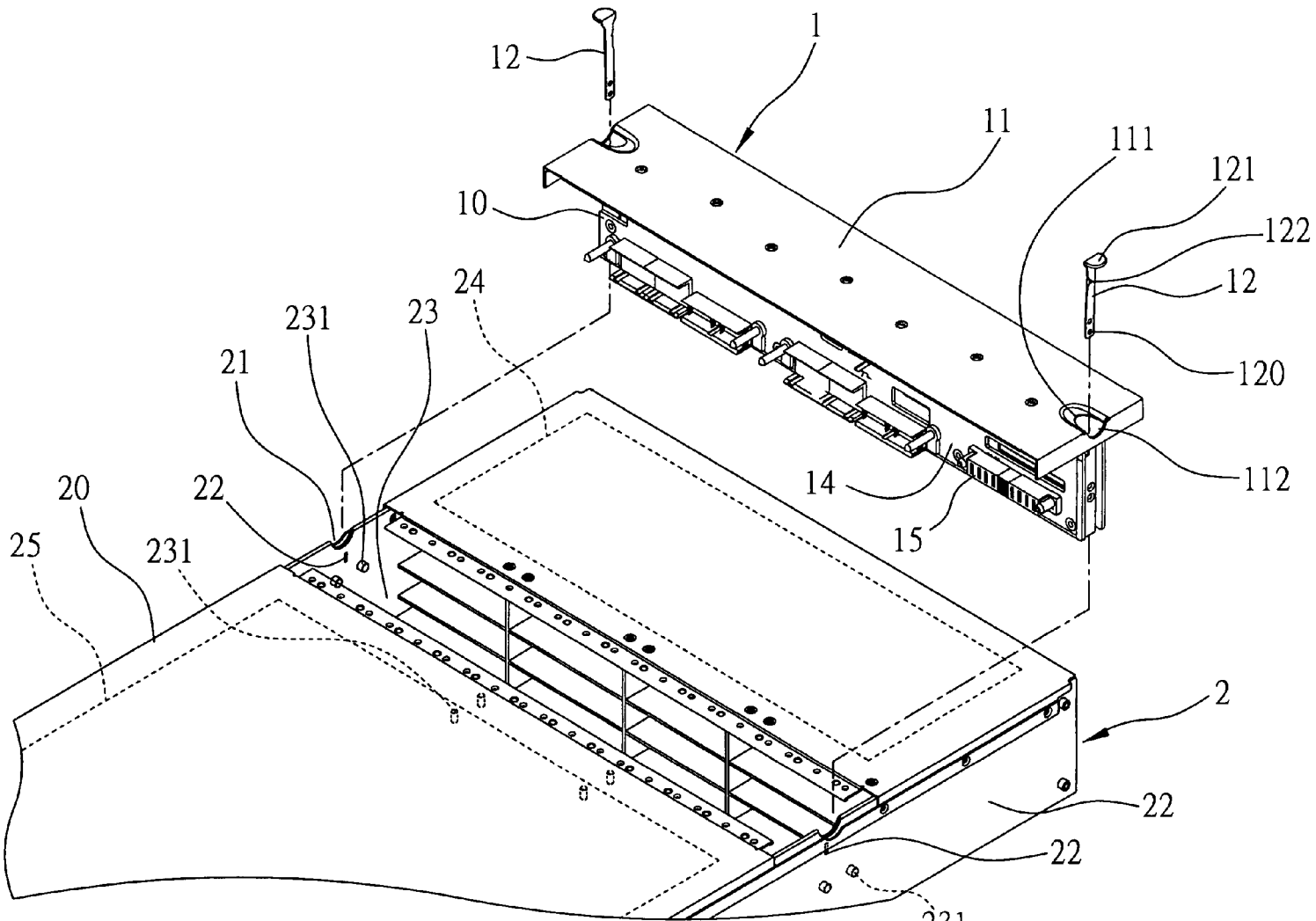
FIG. 3 is an exploded view showing how to install/uninstall the removable electrical interface device shown in FIG. 1 in/from an electronic apparatus in accordance with the present invention.

Referring to FIG. 3 as well, which is an exploded view showing how to install/uninstall the removable electrical interface device 1 in/from the electronic apparatus 2 in accordance with the present invention, an electronic apparatus 2 comprises a casing 20 and the removable electrical interface device 1. The casing 20 is internally disposed with a control unit 25, a storage unit 24, and the slot 23 between the control unit 25 and the storage unit 24. The first coupling portions 22 corresponding in position to two ends of the slot 23, such as fastening holes, are disposed in the casing 20. The removable electrical interface device 1 comprises the body 10 and the lid 11. The body 10 is insertable into the slot 23 and adapted to electrically connect the control unit 25 and the storage unit 24. The lid 11 is perpendicularly connected to a side of the body 10, connectable to a surface of the casing 20, adapted to seal the slot 23, and connectable to the second coupling portions fastenable to the fastening holes 22. Hence, the removable electrical interface device 1 can be installed and uninstalled by a single act. In this embodiment, the second coupling portions are the two resilient fasteners 12 respectively disposed fixedly at the two ends of the body 10 and exposed from the lid 11.

The body 10 is shaped like a panel. The slot 23 adapted to be inserted by the body 10 is defined by a plurality of guiding posts 231 inwardly disposed on two lateral sides and a bottom side of the casing 20. The slot 23 defined by the plurality of guiding posts 231 secures in position the insertedly-disposed body 10, thus stopping the insertedly-disposed body 10 from moving, protecting the insertedly-disposed body 10 against deformation, allowing the hooks 122 of the resilient fasteners 12 connectedly disposed in the body 10 and lid 11 of the removable electrical interface device 1 to snap into the fastening holes 22 of the electronic apparatus 2 and therefore coupling the removable electrical interface device 1 and the electronic apparatus 2 together, allowing the lid 11 to cover the slot 23 of the electronic apparatus 2, allowing the control unit 25 and storage unit 24 inside the electronic apparatus 2 to be electrically connected to each other by means of electrical ports 15, and preventing invasion of pollutants into the electronic apparatus 2.

A dent portion 21 corresponding in position to the second opening 112 of the lid 11 is disposed in an edge of the casing 20 of the electronic apparatus 2 to allow the user to push the operating flange 121 with a finger.

To uninstall the removable electrical interface device 1 from the electronic apparatus 2, the user only needs to push the operating flange 121 of each of the resilient fasteners 12 toward the first opening 111 of the lid 11, and doing so bends the resilient fasteners 12 and even frees the hooks 122 from the fastening holes 22 of the electronic apparatus 2, thus allowing the user to withdraw the removable electrical interface device 1 from the electronic apparatus 2.

A removable electrical interface device of the present invention comprises a body and a lid perpendicularly and integrally connected to each other to reinforce the structural strength of the body. The removable electrical interface device is insertable into a receiving space of an electronic apparatus like a server. Circuit boards equipped with electrical ports are disposed on the removable electrical interface device and adapted to electrically connect a control unit and a storage unit in the electronic apparatus. Fastening resilient fasteners connectedly disposed in the body and the lid to the electronic apparatus secures in position the removable electrical interface device in the receiving space of the electronic apparatus. On the other hand, to uninstall the removable electrical interface device from the electronic apparatus, a user only needs to push the resilient fasteners until the resilient fasteners snap out of the lid, and then the user withdraws the lid and body from the receiving space of the electronic apparatus. Accordingly, the user installs/uninstalls the removable electrical interface device in/from the electronic apparatus easily.

The aforesaid embodiment merely serves as the preferred embodiment of the present invention. It should not be construed as to limit the scope of the present invention in any way. Hence, any other changes can actually be made in the present invention. It will be apparent to those skilled in the art that all equivalent modifications or changes made, without departing from the spirit and the technical concepts disclosed by the present invention, should fall within the scope of the appended claims.

What is claimed is:

1. A removable electrical interface device insertable into an electronic apparatus disposed with a slot and two first coupling portions, the removable electrical interface device comprising:

a body insertable into the slot and electrically connected to the electronic apparatus; and a lid perpendicularly connected to a side of the body, connectable to a surface of the electronic apparatus, adapted to seal the slot, and having two leaf springs fastenable to the two first coupling portions respectively and respectively disposed fixedly at two ends of the body and exposed from the lid and each having a top end disposed with an operating flange exposed and protruding out of the lid, thus allowing the removable electrical interface device to be installed and uninstalled by a single act, wherein the lid is disposed with a first opening for exposing the operating flange of each of the resilient fasteners, a lateral side of the lid is disposed with a second opening communicating with the first opening and allowing the operating flange to be pushed from the lateral side of the lid, and a hook is disposed on each of the leaf springs, flanked by the operating flange, and fastenable to a respective one of the first coupling portions of the electronic apparatus.

2. The removable electrical interface device of claim 1, wherein two opposing sides of the body are each disposed with a circuit board having an electrical port for electrically connecting the control unit and the storage unit.

3. An electronic apparatus, comprising:

a casing disposed internally with a control unit, a storage unit, and a slot between the control unit and the storage unit and disposed with two first coupling portions respectively corresponding in position to two ends of the slot; and a removable electrical interface device having a body and a lid, the body being insertable into the slot and adapted to electrically connect the control unit and the storage unit, the lid being perpendicularly connected to a side of the body, connectable to a surface of the casing, adapted to seal the slot, and having two second coupling portions fastenable to the two first coupling portions respectively, thus allowing the removable electrical interface device to be installed and uninstalled by a single act, wherein two opposing sides of the body are each disposed with a circuit board having an electrical port for electrically connecting the control unit and the storage unit.

4. The electronic apparatus of claim 3, wherein the body is shaped like a panel, and the slot adapted to be inserted by the body is defined by a plurality of guiding posts inwardly disposed on two lateral sides and a bottom side of the casing.

5. The electronic apparatus of claim 3, wherein the two second coupling portions are two resilient fasteners respectively disposed fixedly at two ends of the body and exposed from the lid.

6. The electronic apparatus of claim 5, wherein the resilient fasteners are leaf springs.

7. The electronic apparatus of claim 5, wherein the resilient fasteners are fixedly fastened to the body, and each has a top end disposed with an operating flange exposed and protruding out of the lid.

8. The electronic apparatus of claim 7, wherein a hook is disposed on each of the resilient fasteners, flanked by the operating flange, and fastenable to a respective one of the first coupling portions of the electronic apparatus.

9. The electronic apparatus of claim 7, wherein the lid is disposed with a first opening for exposing the operating flange of each of the resilient fasteners.

10. The electronic apparatus of claim 9, wherein a lateral side of the lid is disposed with a second opening communicating with the first opening and allowing the operating flange to be pushed from the lateral side of the lid.

* * * * *